US006792883B2

(12) United States Patent
Ashton

(10) Patent No.: US 6,792,883 B2
(45) Date of Patent: Sep. 21, 2004

(54) SEWN ARTICLE AND METHOD OF MAKING

(75) Inventor: Ronald Ashton, Warwickshire (GB)

(73) Assignee: Eagle Ottawa, LLC, Rochester Hills, MI (US)

( * ) Notice: Subject to any disclaimer, the term of this patent is extended or adjusted under 35 U.S.C. 154(b) by 218 days.

(21) Appl. No.: 10/097,878

(22) Filed: Mar. 14, 2002

(65) Prior Publication Data

US 2002/0152939 A1 Oct. 24, 2002

Related U.S. Application Data

(60) Provisional application No. 60/282,730, filed on Apr. 10, 2001.

(51) Int. Cl.[7] ..... D05B 15/00; D05B 35/06; D05B 29/04

(52) U.S. Cl. ..... 112/475.01; 112/470.27; 112/235; 112/260

(58) Field of Search ..... 112/475.01, 475.06, 112/475.17, 260, 163, 441, 418, 419, 475.03, 475.08, 52, 46, 152, 157, 470.27, 28, 47, 51, 137, 235, 324

(56) References Cited

U.S. PATENT DOCUMENTS

| | | | | | |
|---|---|---|---|---|---|
| 319,453 | A | * | 6/1885 | Cobleigh | 112/418 |
| 1,220,524 | A | * | 3/1917 | McNeil | 112/475.01 |
| 1,316,426 | A | * | 9/1919 | Clark | |
| 2,115,907 | A | | 5/1938 | Engel | 112/52 |
| 2,353,984 | A | * | 7/1944 | Barone | 112/414 |
| 2,576,324 | A | * | 11/1951 | Wirt | 112/419 |
| 2,667,849 | A | * | 2/1954 | Rohrlick et al. | 112/105 |
| 3,940,812 | A | * | 3/1976 | DiForti et al. | 112/418 |
| 4,063,524 | A | * | 12/1977 | Ochiai | 112/152 |

* cited by examiner

*Primary Examiner*—Ismael Izaguirre
(74) *Attorney, Agent, or Firm*—Quarles & Brady LLP

(57) ABSTRACT

An article and an apparatus and method for making the article. The article including a first piece of material having a margin extending inwardly from an edge of the material. The margin has an inner edge spaced from the material edge. A second piece of material having a margin extending inwardly from an edge of the second material is joined to the first piece of material along inner edges of the margins. A third piece of material is fixed over the margins, and has a first edge fixed to the first piece of material and a second edge fixed to the second piece of material.

26 Claims, 8 Drawing Sheets

SEWN ARTICLE AND METHOD OF MAKING

CROSS REFERENCES TO RELATED APPLICATIONS

This application claims the benefit of U.S. Provisional Patent Application No. 60/282,730 filed on Apr. 10, 2001.

STATEMENT REGARDING FEDERALLY SPONSORED RESEARCH

Not Applicable

BACKGROUND OF THE INVENTION

The present invention relates to sewing, in particular to a sewn article, sewing machine for sewing the sewn article, and a method for sewing two or more pieces to form the sewn article.

Multiple pieces of material are often sewn together to form a single large piece of material. For example, a covering for a leather seat in an automobile comprises two or more pieces of leather which are sewn together along edges of the individual leather pieces. The seam between the two pieces, must be strong to prevent the pieces from separating, and, in the example of a car seat covering, the seam must be decorative, or pleasing to the consumer.

A known method, shown in FIGS. 1 and 2, used to join two pieces of leather for car seat covering includes positioning the two pieces of leather on top of each other, such that the finished surfaces of the pieces are facing each other, and sewing a first seam spaced inwardly from an edge of the pieces to define a selvedge between the seam and the edge of each piece of leather. The material is then laid flat, such that the finished surfaces of the leather pieces face upwardly, and the selvedge of each piece of leather is folded back in a butterfly fashion, underneath the respective leather piece. A twin needle sewing machine is then used to sew a seam on opposing sides of the first seam and through the folded selvedge. The twin needle sewing machine has two needles to simultaneously sew the two seams on opposing sides of the first seam. Each needle penetrates the leather to provide a decorative twin needle stitch. The sewn selvedge increases the strength of the triple seam, and prevents the sewn article from tearing.

This particular method has been in use for many years. However, folding the selvedge back in a butterfly fashion underneath the leather pieces is difficult for the sewing machine operator. Moreover, the material, such as leather, is expensive, and the selvedge must be large enough, such as 7–10 mm, to fold back and engage one of the needles of the twin needle sewing machine. Therefore, a need exist for a decorative stitch which has sufficient strength for a desired application, and has a minimal selvedge.

SUMMARY OF THE INVENTION

The present invention provides an article including a first piece of material having a margin extending inwardly from an edge of the material. The margin has an inner edge spaced from the material edge. A second piece of material having a margin extending inwardly from an edge of the second material is joined to the first piece of material along inner edges of the margins. A third piece of material is fixed over the margins, and has a first edge fixed to the first piece of material and a second edge fixed to the second piece of material.

The article is made by positioning the first piece of material over the second piece of material, and aligning an edge of the first piece of material with an edge of the second piece of material. The pieces are fixed together along a seam line which is a predetermined distance from the aligned edges to define a selvedge in each piece of material between the seam line and each aligned edge. The third piece of material is positioned covering the selvedges, and fixed to the other pieces of material along a line substantially parallel to said seam line.

A general objective of the present invention is to provide a sewn article with a minimal selvedge length. This objective is accomplished by joining two pieces of material together with a joining seam, and then fixing a third piece of material over the selvedges to the first two pieces of material.

This and still other objects and advantages of the present invention will be apparent from the description which follows. In the detailed description below, preferred embodiments of the invention will be described in reference to the accompanying drawings. These embodiments do not represent the full scope of the invention. Rather the invention may be employed in other embodiments. Reference should therefore be made to the claims herein for interpreting the breadth of the invention.

DETAILED DESCRIPTION OF THE INVENTION

Figure 1:
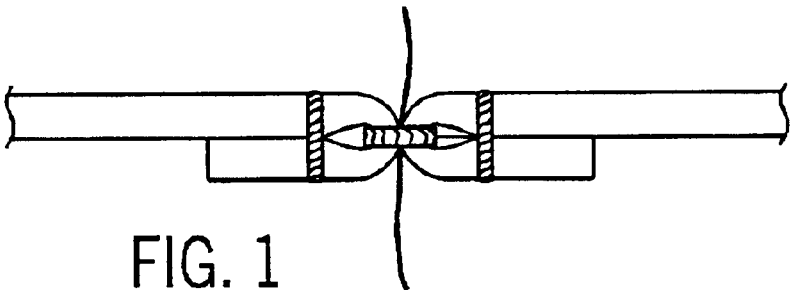
FIG. 1 PRIOR ART
FIG. 1 is a cross sectional view of prior art sewn article.
Figure 2:
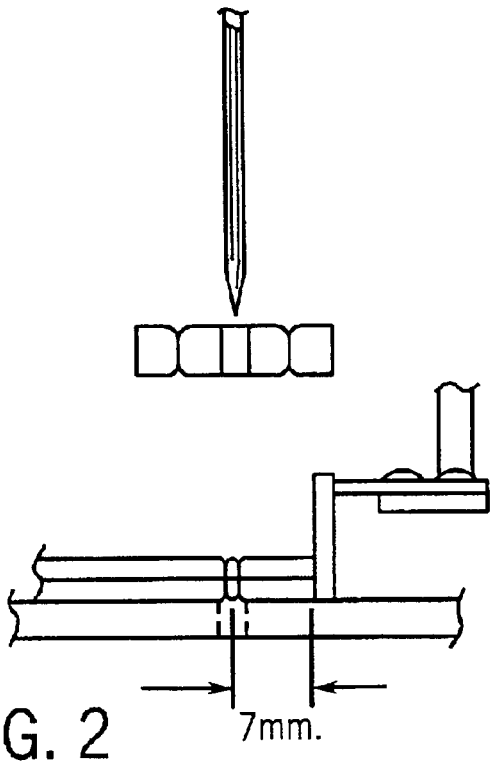
FIG. 2 PRIOR ART
FIG. 2 is a cross sectional view of an intermediate assembly of the prior art sewn article of FIG. 1 prior to completion.

As shown in FIGS. 3–6, a finished sewn article 10 is formed from two pieces 12, 14 of planar, flexible material sewn together. The margin 16 of each piece 12, 14 extends inwardly from an edge 18 of each piece 12, 14 a predetermined selvedge length defining a selvedge 20. A joining seam 22 sewn through each selvedge 20 fixes the selvedges 20 relative to each other to join the pieces 12, 14 together along a joint 36. A tape 24 sewn over the selvedges 20 strengthen the joint 36 between the two pieces 12, 14.

Each piece 12, 14 of material has a finished surface 26 and an unfinished surface 28. The unfinished surface 28, can include a backing material 30, such as foam, fixed to the piece 12, 14 using methods known in the art, such as adhesives, and the like. When the pieces 12, 14 are laid flat, the finished surface 26 of each piece 12, 14 defines a plane. The pieces 12, 14 can be any sewable material known in the art, such as synthetic or natural leather, fabric, and the like, with or without backing material. Although, pieces 12, 14 having a finished and unfinished surface are disclosed, the pieces 12, 14 can have two finished surface or no finished surfaces without departing from the scope of the intention. Moreover, even though joining two pieces is disclosed, two or more pieces of material can be joined without departing from the scope of the invention.

The elongated tape 24 extends along the margins 16 of the two pieces 12, 14, and covers the selvedges 20. A longitudinal edge 32, 34 of the tape 24 is fixed to each piece 12, 14 of material, and each edge 32, 34 is joined by a tape web 42. Fixing the tape 24 to each piece 12, 14 across the joint 36, increases the tensile strength and integrity of the joint 36 between the two pieces 12, 14. The tape 24 can be any type of material known in the art which can be joined to the pieces 12, 14 of material using methods known in the art, such as sewing, adhesives, rivets, and the like. Preferably, the tape 24 is formed from nylon, however, any tape material known in the art which strengthens the joint between the pieces 12, 14 can be used, without departing from the scope of the invention.

Figure 3:
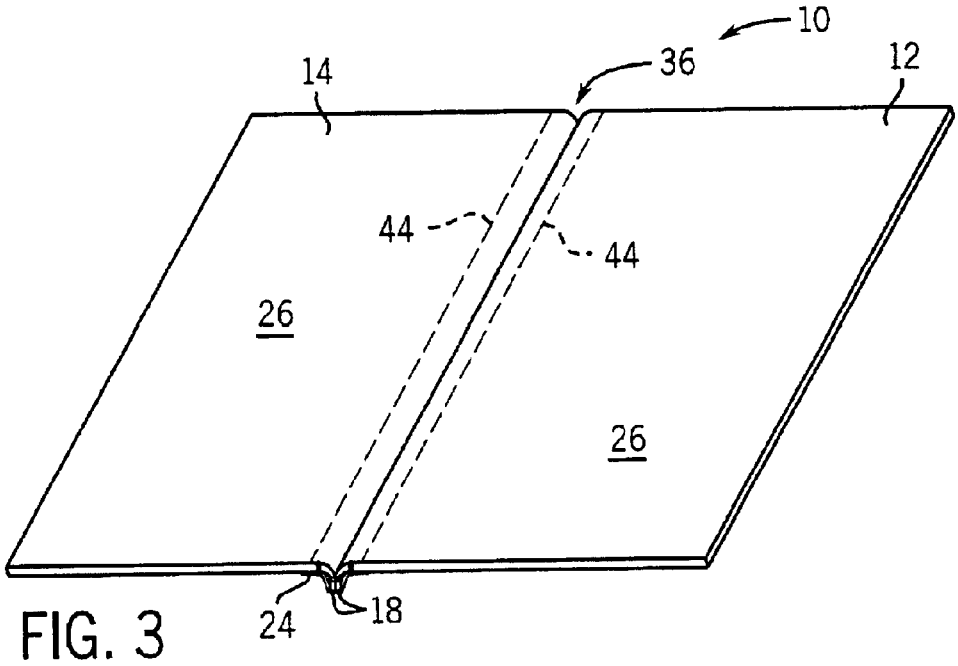
FIG. 3 is a perspective view of a sewn article incorporating the present invention.
Figure 4:
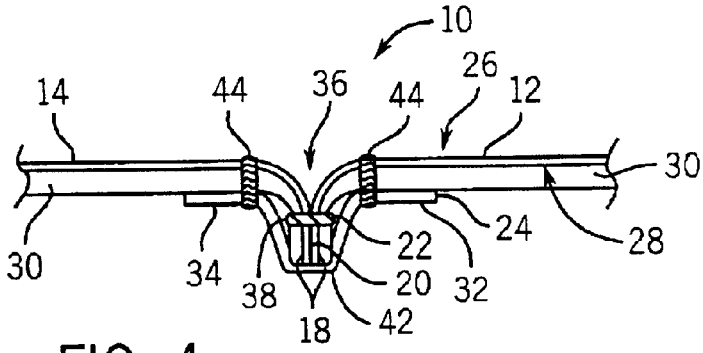
FIG. 4 is a cross sectional view of the sewn article of FIG. 3.
Figure 5:
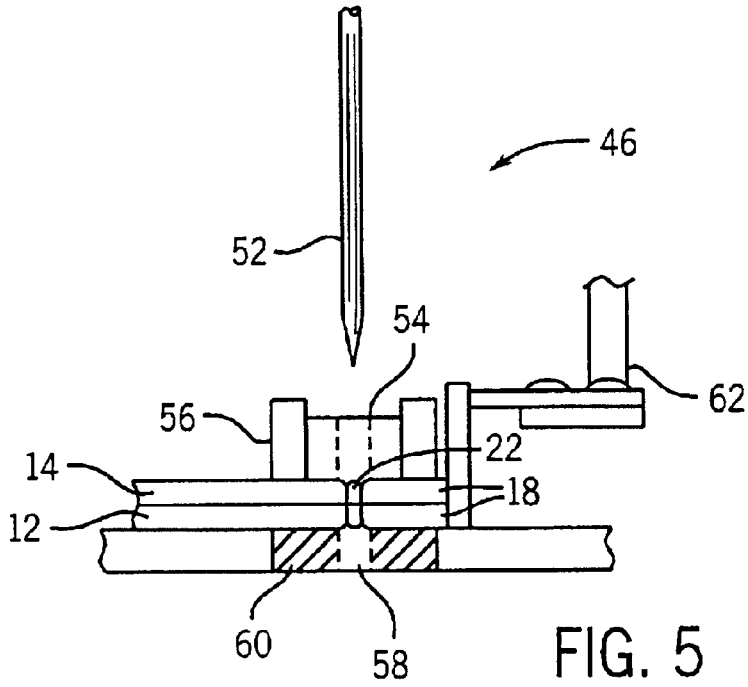
FIG. 5 is a cross sectional view of an intermediate assembly of the sewn article of FIG. 3.
Figure 6:
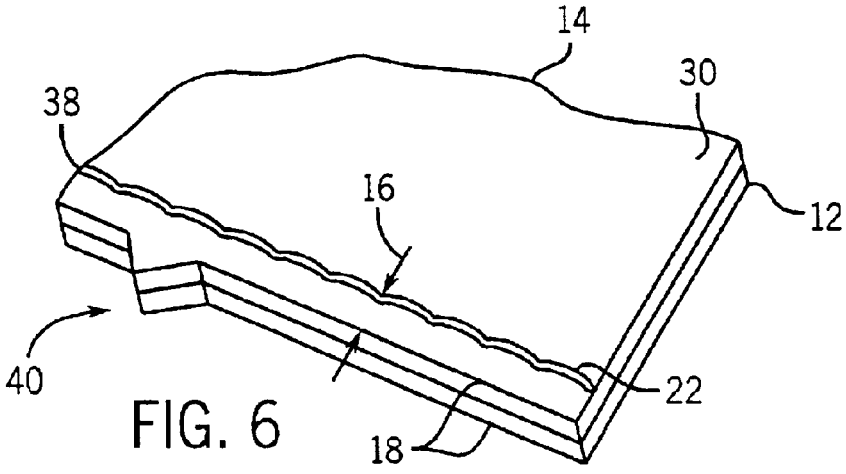
FIG. 6 is a perspective view of the intermediate assembly of FIG. 5.

Referring to FIGS. 3, 5, and 6, the sewn article 10 is fabricated by positioning one of the pieces 12 of material on a flat surface with the finished surface 26 facing upwardly, and positioning the other piece 14 of material over the first piece 12, such that the finished surfaces 26 of both pieces 12, 14 are facing each other. The edge 18 of both pieces 12, 14 of material that are to be sewn together are aligned, and the joining seam 22 is sewn along an inner edge 38 of the margins 16 using a single needle sewing machine 46. An alignment mark 40, such as an external "V", can be formed in each piece edge 18 for the operator to properly align the pieces 12, 14 in the sewing machine. Preferably, the margins are approximately 3 mm in width to avoid wasting material.

Figure 7:
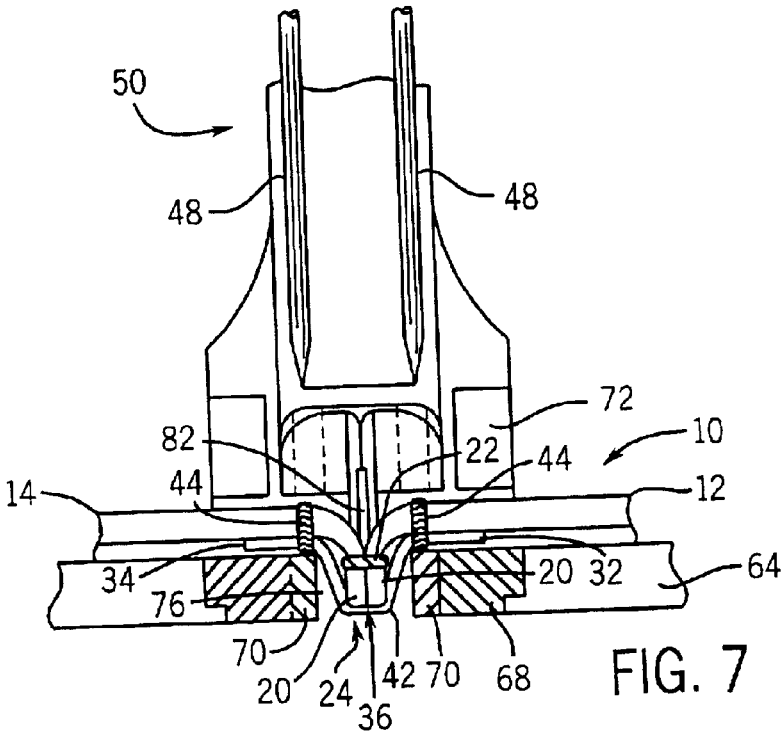
FIG. 7 is a cross sectional view of the sewn article of FIG. 3 positioned in a twin needle sewing machine.

As shown in FIG. 7, once the two pieces 12, 14 are joined, the pieces 12, 14 of material are laid flat, such that the selvedges 20 extend substantially perpendicular to the plane defined by the pieces 12, 14 of material. The tape 24 is positioned over the selvedges 20, such that each longitudinal edge 32, 34 of the tape 24 overlaps a portion of one of the pieces 12, 14 of material. The tape 24 can be temporarily fixed to the pieces 12, 14 using adhesives, adhesive tape, and the like, to avoid movement of the tape 24 when permanently fixing the tape 24 to the pieces 12, 14.

Once the tape 24 is positioned over the selvedges 20, the selvedges 20 and tape web 42 are aligned between the needles 48 of a twin needle sewing machine 50. The pieces 12, 14 are then fed through the twin needle sewing machine 50, and a pair of parallel decorative seams 44 are sewn into the pieces 12, 14 of material on opposing sides of the selvedges 20, such that each decorative seam 44 fixes one of the longitudinal edges 32, 34 of the tape 24 to one of the pieces 12, 14 of material.

In the article 10 disclosed herein, the joining 22 seam is applied using the single needle sewing machine 46, and the tape 24 is fixed to each piece 12, 14 of material using the twin needle sewing machine 50 which simultaneously applies the decorative seams 44 on opposing sides of the joint 36 between the two pieces 12, 14 of material. Each decorative seam 44 of the pair of decorative seams 44 fixes an edge 32, 34 of the tape 24 to one of the piece 12, 14.

Referring back to FIG. 5, the single needle sewing machine 46 includes a body which supports a reciprocating needle 52. The needle 52 passes through an aperture 54 formed in a presser foot 56, both pieces 12, 14 of material, and into an opening 58 formed in a needle plate 60. The needle 52 passes thread through the pieces 12, 14 of material to join the pieces 12, 14 together, as is known in the art.

A guide 62 positioned adjacent the needle 52 can engage the edge 18 of the pieces 12, 14 of material to guide the pieces 12, 14 as they pass underneath the needle 52. If the guide 62 is used, in order to accommodate a small selvedge, such as a selvedge of less than 8 mm, the presser foot 56 is modified to a half-width of less than 8 mm. Preferably, the presser foot 56 has a half-width of no more than 3 mm, to allow a selvedge of 3 mm or less.

Referring to FIGS. 7–11, the twin needle sewing machine 50 includes a body 62 which supports the pair of parallel, reciprocating needle 48, and a bed 64 having an upper surface 65. The bed 64 houses a feed dog 66 which extends through a needle plate 68 supported by the bed 64. Each needle 48 passes through one of the pieces 12, 14 of material and into needle openings 70 formed in the feed dog 66 to apply the decorative, parallel seams 44 in the article 10.

Referring to FIGS. 7–11, the needle plate 68 extends above the bed upper surface 65 to provide a raised platform which supports the portion of the article 10 being sewn. A ramp 71 formed in a forward portion 73 of the needle plate 68 upstream of the feed dog 66 provides a smooth transition for the tape 24 and pieces 12, 14 of material from the bed surface 65 to the top 75 of the needle plate 68. Preferably, the needle plate 68 has a width which is approximately equal to the sewn width of the tape 24 to support the tape 24 as it is fixed to the pieces 12, 14 of material. In addition, preferably, the top 75 of the needle plate 68 is spaced above the bed surface 65 no less than the selvedge length to provide a substantially flat article 10 as the selvedge passes through the a slot 76 formed in the needle plate top 75.

The slot 76 is formed in the needle plate 68, and is aligned to extend between the needles 48 in the direction of travel of the article 10 being sewn together. The slot 76 receives the joined selvedges 20 and web 42 of the tape 24 to present the needles 48 with relatively flat article 10 for receiving the needles 48. Preferably, the slot 76 extends through the entire length of the needle plate 68 to provide a continuous pathway for the joined selvedges 20 and web 42 of the tape 24 past the needles 48.

Figure 9:
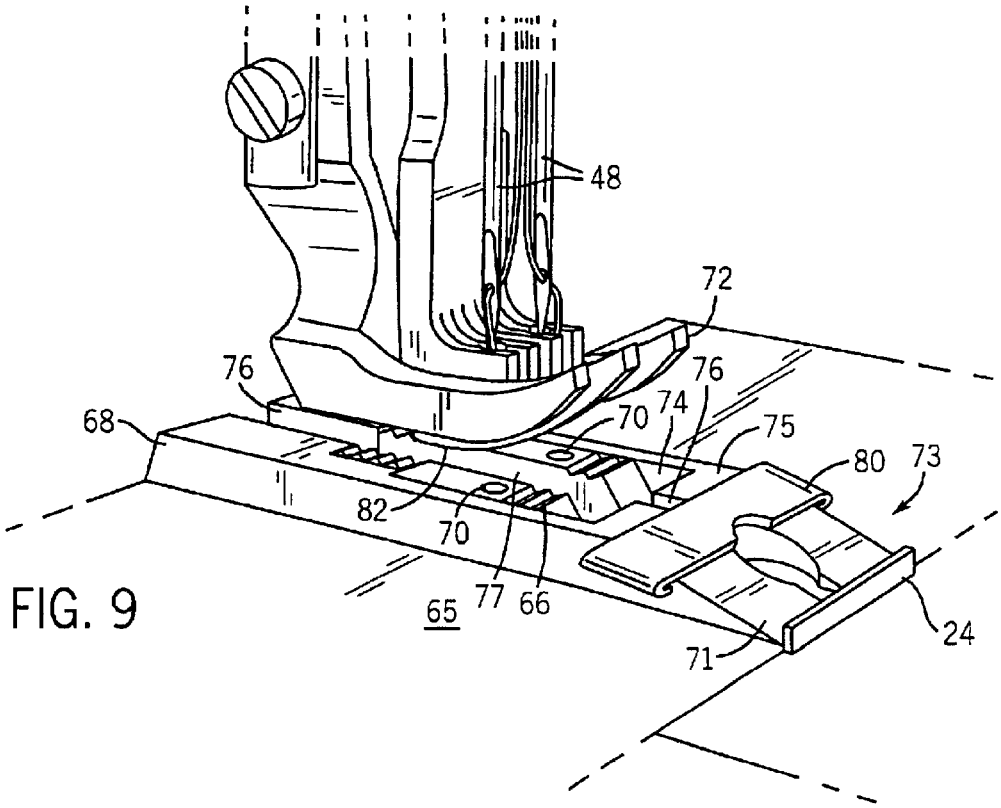
FIG. 9 is a detailed perspective view of the needle plate and presser foot of FIG. 8.
Figure 10:
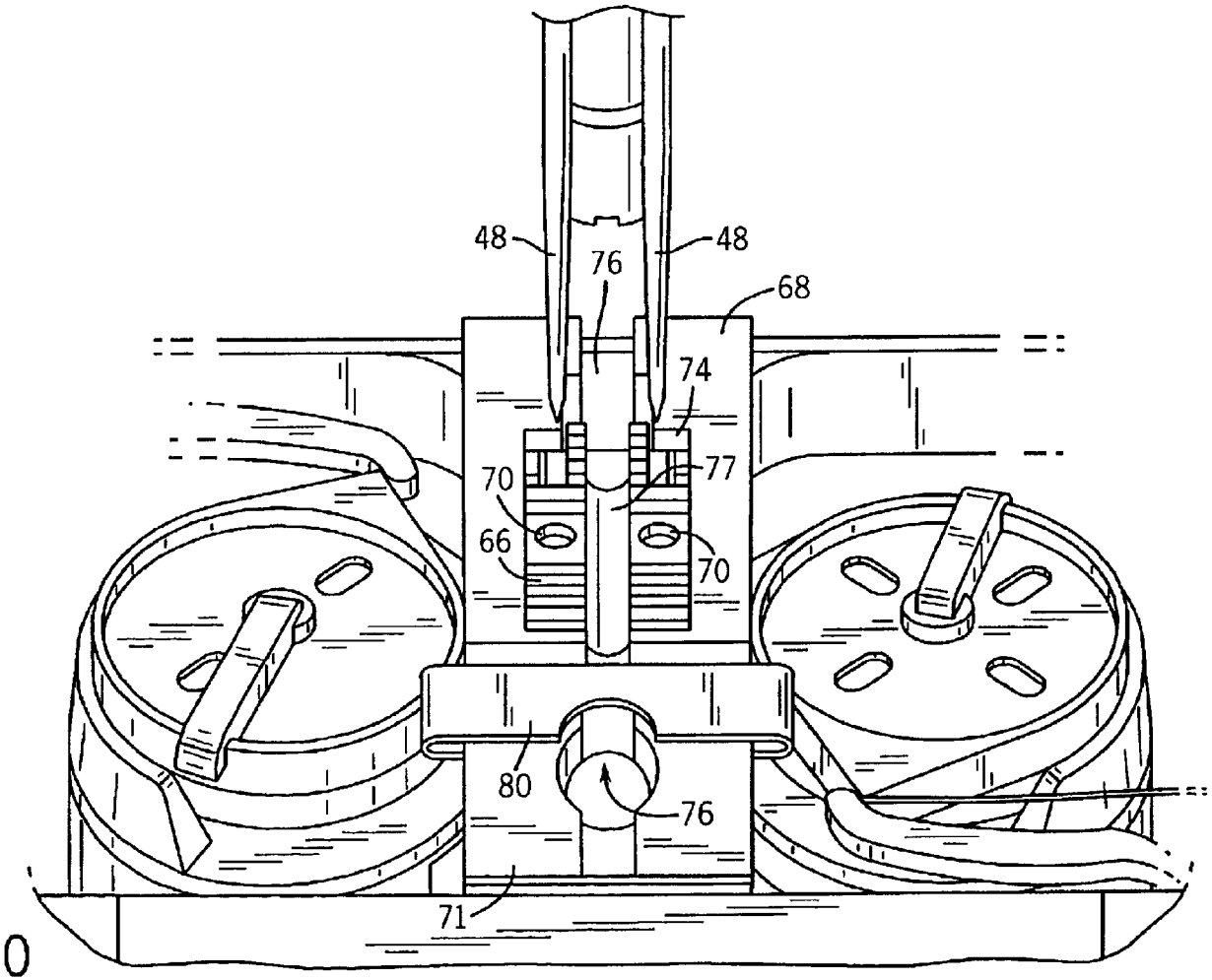
FIG. 10 is a top, front perspective view of the needle plate of FIG. 8 with the presser foot and a portion of the bed upper surface removed.

As shown in FIGS. 9 and 10, a tape guide 80 is fixed to the needle plate 68, and extends across the needle plate ramp 71 to guide the tape 24 as it is fixed to the pieces 12, 14 of material. Advantageously, the tape guide 80 positions the tape 24 over the needle plate 68 to assure the tape 24 is properly positioned underneath the pieces 12, 14 of material. Although a tape guide 80 is preferred and disclosed, it is not required to practice the invention.

As shown in FIGS. 7–10, a presser foot 72 is slidably supported above the needle plate 68, and urges the article 10 against the needle plate 68 as the needles 48 pass through the pieces 12, 14 of material. The presser foot 72 includes a projection 82 which extends into the needle plate slot 76, and urges the joining seam 22, selvedges 20, and tape web 42 disposed between the needles 48 into the slot 76. This simplifies the sewing operation, and avoids interference of the needles 48 by the selvedges 20. Advantageously, with the selvedges 20 between the needles 48 disposed in the slot 76, the presser foot 72 can secure each tape edge 32, 34 between one of the pieces 12, 14 of material and the needle plate 68.

Figure 11:
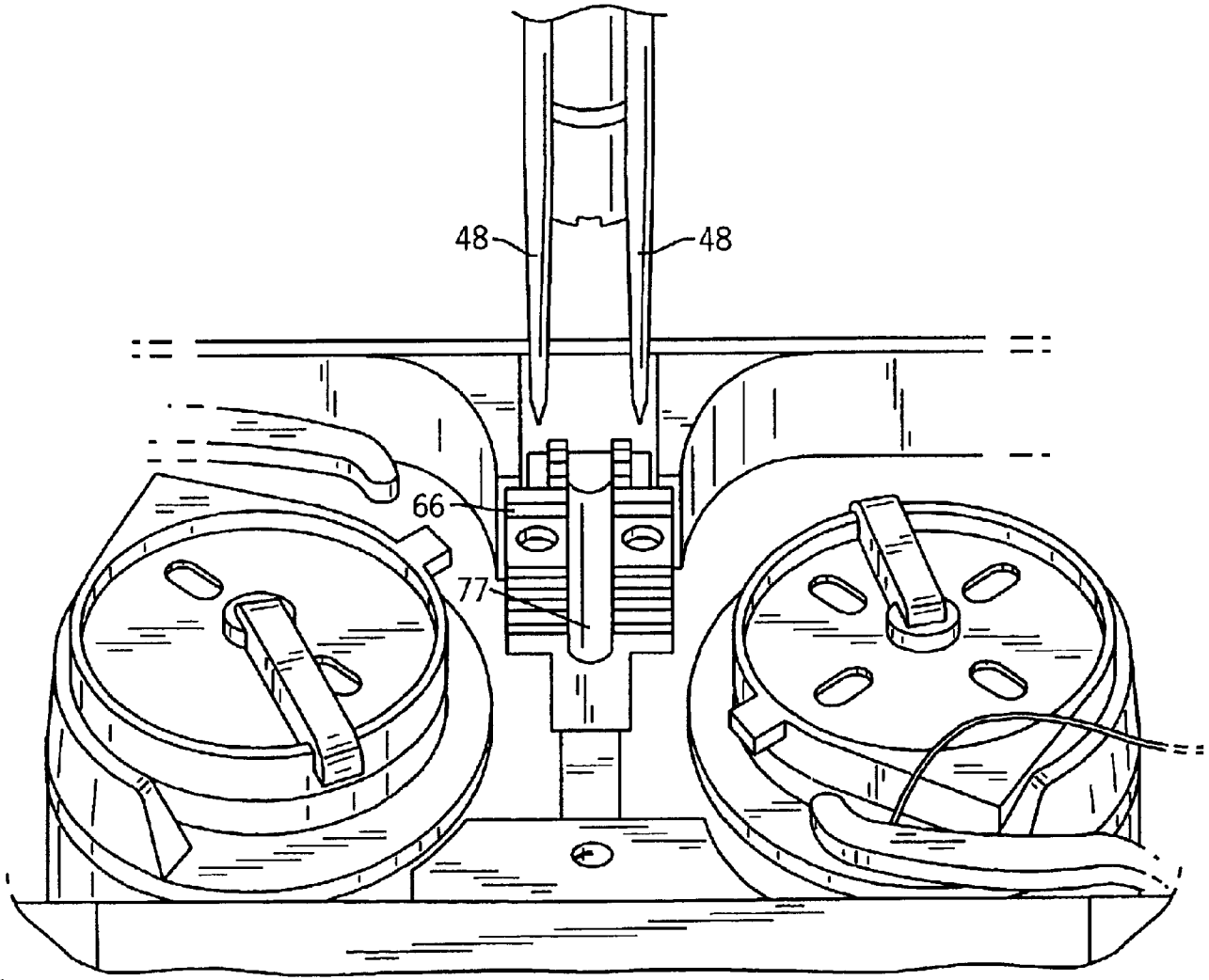
FIG. 11 is a top, front perspective view of the feed dog of FIG. 8 with the needle plate and presser foot removed.

The article 10 is advanced along the direction of travel by the feed dog 66 each time the needles 48 are withdrawn from the article 10 to provide continuous seams in the pieces 12, 14 of material. As shown in FIGS. 9–11, the feed dog 66 extends upwardly through an opening 74 in the needle plate 68, and engages the tape 24 fixed to the pieces 12, 14. The feed dog 66 pinches the article 10 against the presser foot 72, and pulls the article 10 past the needles 48 in the direction of article travel 10. Preferably, the feed dog 66 includes a slot 77 aligned with the needle plate slot 76 to receive the joined selvedges 20 and web 42 of the tape 24, as the article 10 is engaged with the feed dog 66.

Figure 12:
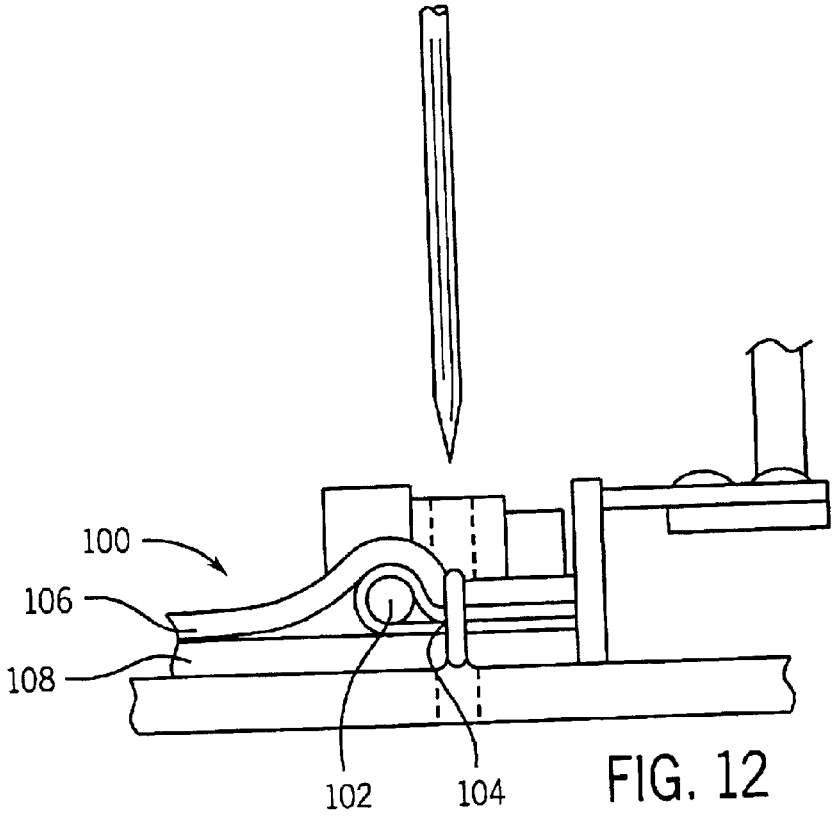
FIG. 12 is an alternative embodiment of an intermediate assembly of a sewn article incorporating the present invention.
Figure 8:
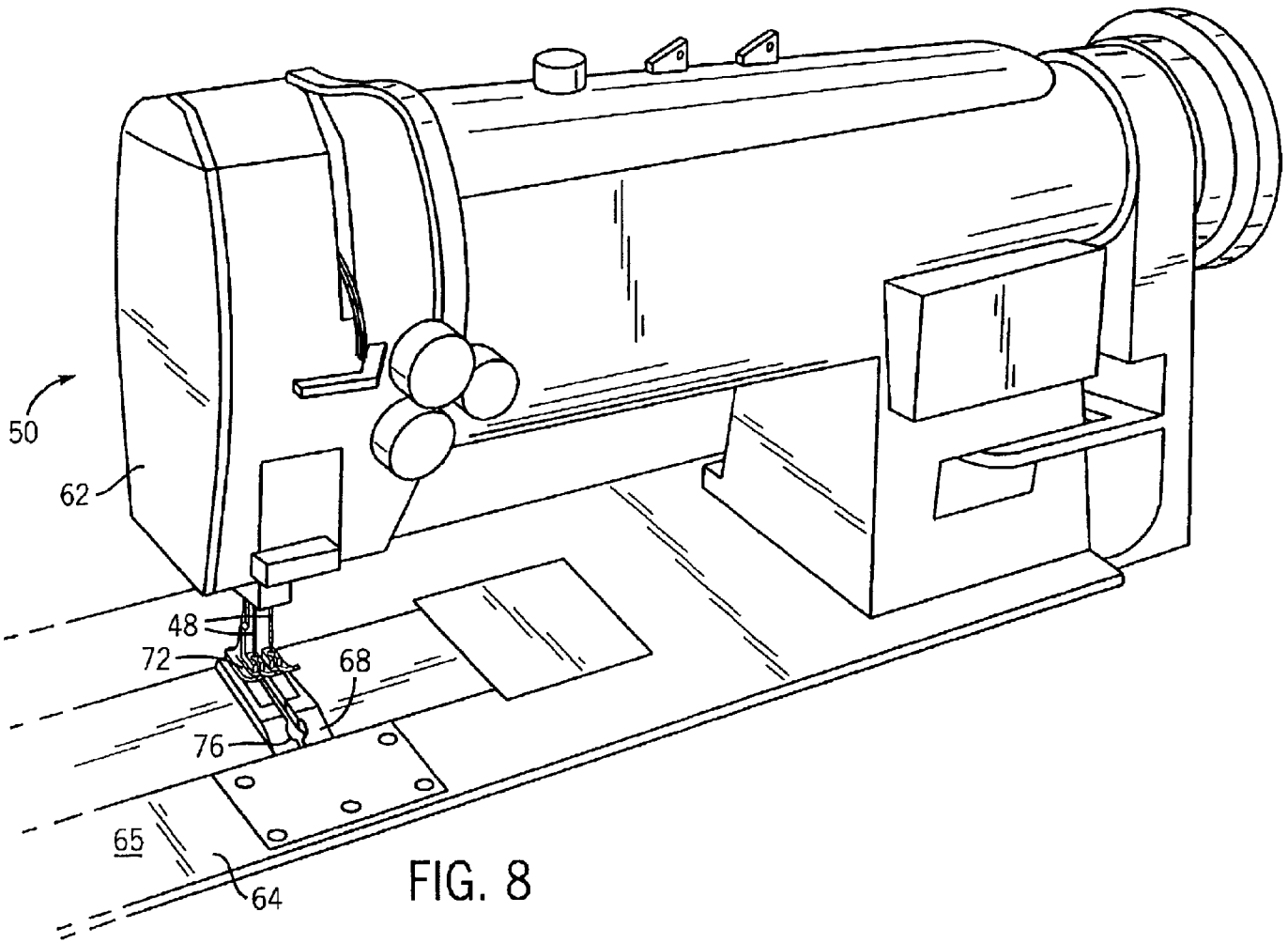
FIG. 8 is a perspective view of a twin needle sewing machine.

An alternative embodiment, shown in FIG. 12, discloses a sewn article 100, in which welting 102 is sewn into the article 100 along the joint 104 between two pieces 106, 108 of material. Advantageously, using the method disclosed above, the selvedge extending from each pieces 106, 108 can be shortened to a length currently not possible in the prior art.

While there has been shown and described what are at present considered the preferred embodiments of the invention, it will be obvious to those skilled in the art that various changes and modifications can be made therein without departing from the scope of the invention defined by the appended claims.

I claim:

1. An article comprising:

a first piece of material having a margin extending inwardly from an edge of the material, said margin having an inner edge spaced from said material edge, said margin having a width defined by the distance between said inner edge and said material edge;

a second piece of material having a margin extending inwardly from an edge of said second material, said margin of said second piece of material having an inner edge spaced from said second material edge and aligned with said margin inner edge of said first material, said margin of said second piece of material having a width defined by the distance between said inner edge of said second piece of material and said second material edge, said second piece of material being fixed to said first piece of material along said aligned inner edges of said margins;

a third piece of material fixed over said margins, and having a first edge fixed to said first piece of material along a line spaced from said inner edge of said first piece of material a distance greater than said width of said margin of said first piece of material and a second edge fixed to said second piece of material along a line spaced from said inner edge of said second piece of material a distance greater than said width of said margin of said second piece of material, wherein said margins extend substantially perpendicular to a plane defined by said first and second pieces of material.

2. The article of claim 1, in which said first and second pieces of material have a finished surface and an unfinished surface, and each edge of said third piece of material is fixed to said unfinished surface of one of said first and second pieces of material.

3. The article of claim 1, in which each of said margins extends substantially perpendicular to a plane defined by said first and second pieces of material when said third piece of material is fixed to said first and second pieces of material.

4. The article of claim 1, in which each margin of said first and second pieces of material has a width which is less than 7 mm between said edge of said respective material and said inner edge of said respective margin.

5. The article of claim 1, in which each margin of said first and second pieces of material has a width which is less than 3 mm between said edge of said respective material and said inner edge of said respective margin.

6. The article of claim 1, in which welting is fixed between said first and second pieces of material.

7. A twin needle sewing machine for joining two pieces of material, said sewing machine comprising:

a body having a bed;

a pair of reciprocating needles supported above said bed by said body for engaging the material to join at least two pieces of material together;

a needle plate disposed beneath said needles and supported by said body, said needle plate having at least one opening for receiving said pair of needles;

a slot formed in said needle plate, and aligned to extend between said needles, wherein said slot can receive material passing between said needles;

a presser foot supported above said needle plate for securing material engaged by said needles; and an extension extending downwardly from said presser foot, and extending into said slot for urging material passing beneath said presser foot and between said needles into said slot.

8. The sewing machine of claim 7, in which a feed dog is fixed below said needle plate, and has a portion extending above said needle plate to engage material passing over said needle plate, said feed dog portion including a slot aligned with said needle plate slot.

9. The sewing machine of claim 7, in which a slot aligned with said needle plate slot is formed in said bed.

10. The sewing machine of claim 7, in which said needle plate extends above said bed to provide a raised platform which supports material being sewn.

11. The sewing machine of claim 10, in which said needle plate has a ramp extending between said bed and a top surface of said needle plate to transition material passing over said bed onto said needle plate.

12. The sewing machine of claim 7, including a guide fixed upstream of said needles over at least a portion of said needle plate to guide a material over said needle plate.

13. A twin needle sewing machine for joining at least two pieces of material, said sewing machine comprising:

a body having a bed;

a pair of reciprocating needles supported above said bed by said body for engaging the material to join at least two pieces of material together;

a needle plate disposed beneath said needles and supported by said body, said needle plate having at least one opening for receiving said pair of needles, said needle plate having a top surface above said bed to provide a raised platform for supporting material engaged by said needles, in which said needle plate includes a slot aligned to extend between said needles, wherein said slot receives material passing between said needles;

a presser foot supported above said needle plate for securing material engaged by said needles; and an extension extending into said slot for urging material passing beneath said presser foot and between said needles into said slot.

14. The sewing machine of claim 13, including a guide fixed upstream of said needles over at least a portion of said needle plate to guide a material over said needle plate.

15. The sewing machine of claim 13, in which a feed dog is fixed below said needle plate, and has a portion extending above said needle plate to engage material passing over said needle plate, said feed dog portion including a slot aligned with said needle plate slot.

16. The sewing machine of claim 13, in which a slot aligned with said needle plate slot is formed in said bed.

17. A twin needle sewing machine for joining at least two pieces of material, said sewing machine comprising:

a body having a bed;

a pair of reciprocating needles supported above said bed by said body for engaging the material to join at least two pieces of material together;

a needle plate disposed beneath said needles and supported by said body, said needle plate having at least one opening for receiving said pair of needles, said needle plate having a top surface above said bed to provide a raised platform for supporting material engaged by said needles; and a ramp extending between said bed and said top surface to transition material passing over said bed onto said needle plate.

18. The sewing machine of claim 17, in which said needle plate includes a slot aligned to extend between said needles, wherein said slot receives material passing between said needles; and an extension extends downwardly from said presser foot and into said slot for urging material passing beneath said presser foot and between said needles into said slot.

19. A method of joining two pieces of material, said method comprising:

positioning a first piece of material over a second piece of material;

aligning an edge of said first piece of material with an edge of said second piece of material;

fixing said first piece of material to said second piece of material along a seam line which is a predetermined distance from said aligned edges to define a selvedge in each piece of material between said line and each aligned edge;

covering said selvedges with a third piece of material;

urging said selvedges into a slot extending between a pair of needles of a two needle sewing machine after said selvedges are covered by said third piece of material;

fixing said third piece of material to said first piece of material along a line substantially parallel to said seam line using one of said needles of said pair of needles, said line being spaced from said seam line a distance greater than the length of said selvedge of said first piece of material; and fixing said third piece of material to said second piece of material along a line substantially parallel to said seam line using the other of said needles of said pair of needles.

20. The method of claim 19, in which said predetermined distance is less than 7 mm.

21. The method of claim 19, in which said predetermined distance is less than 3 mm.

22. A method of joining two pieces of material, said method comprising:

positioning a first piece of material over a second piece of material;

aligning an edge of said first piece of material with an edge of said second piece of material;

fixing said first piece of material to said second piece of material along a seam line which is a predetermined distance from said aligned edges to define a selvedge in each piece of material between said line and each aligned edge;

urging said selvedges into a slot extending between a pair of needles of a two needle sewing machine; and stitching a thread on opposing sides of said seam line to define a decorative twin needle stitch.

23. The method of claim 22, in which said predetermined distance is less than 7 mm.

24. The method of claim 22, in which said predetermined distance is less than 3 mm.

25. The method of claim 22, in which said slot is formed in a needle plate having a top surface raised above a top surface of a bed of said twin needle sewing machine.

26. The method of claim 22, including covering said selvedges with a third piece of material, and fixing said third piece of material to said first and second pieces of material on opposing sides of said seam line.

* * * * *